United States Patent [19]

Nakamura

[11] Patent Number: 4,705,167

[45] Date of Patent: Nov. 10, 1987

[54] BUTTON FEED TAPE

[75] Inventor: Masaya Nakamura, Chofu, Japan

[73] Assignee: Tokyo Juki Industrial Co., Ltd., Tokyo, Japan

[21] Appl. No.: 878,124

[22] Filed: Jun. 25, 1986

[30] Foreign Application Priority Data

Jun. 29, 1985 [JP] Japan ..... 60-143581

[51] Int. Cl.[4] ..... A44B 7/00; A44B 1/00

[52] U.S. Cl. ..... 206/348; 206/820; 2/266; 428/136; 428/137; 428/906

[58] Field of Search ..... 428/136, 137, 906; 206/348, 820; 2/265, 266

[56] References Cited

U.S. PATENT DOCUMENTS 2,302,045 11/1942 Neumann et al. ..... 206/348 X 3,478,409 11/1969 Votaw et al. ..... 428/137 X

*Primary Examiner*—Alexander S. Thomas

*Attorney, Agent, or Firm*—Morgan & Finnegan

[57] ABSTRACT

A button feed tape used to supply buttons for a button stitching machine comprising an upper sheet and a lower sheet with the buttons sandwiched therebetween. The upper and lower sheets provide openings to expose the buttons and to allow easy separation of the sheets from the buttons after the buttons are stitched. The button feed tape is fed by sprocket holes provided along the sides of the button feed tape.

3 Claims, 4 Drawing Figures

BUTTON FEED TAPE

BACKGROUND OF THE INVENTION

The invention relates to a tape used to feed clothing accessories like buttons, hooks, and snaps during the sewing process.

Generally, the buttons, hooks, or snaps fed to a workpiece fabric during the sewing process are packaged in a box or a bag. When buttons are stitched manually or sewed by a machine specially designed for such purposes, this presents no problem in sewing buttons. More recently however, in view of higher levels of automation and less manual work, such sewing processes have become problematic and require improvement.

In conventional button feeding apparatus, buttons are supplied to a bowl in batches and the buttons are separated and arranged in one line in a guide and kept front side facing up. This process is conducted by a special vibrating device. Thereafter, buttons are rotated to align their button holes with guide pins placing the button in a ready-to-transfer position. Subsequently, a loading device, provided at the sewing machine, transfers the buttons to the correct position on the fabric, clamps them, and the sewing machine starts stitching.

Such conventional mechanisms are very complicated, bulky, and expensive even though the button positioning process is only a preliminary part of button stitching work. Additionally, due to unequal button shape or malfunction of the complicated mechanism, it is unavoidable that some buttons are incorrectly stitched. In such cases, time is wasted amending the problem and in the worst cases, the workpiece itself is judged to be inferior goods. Further, when several kinds of buttons are stitched to a workpiece, the button positioning mechanism requires a change each time the buttons are changed. This represents a major impediment to total automation of apparel stitching work.

In response to this problem, Japanese Patent No. 56-27294 discloses a button feeding tape on which a plurality of buttons are detachably secured in a line. A drawback of this arrangement is that it is difficult to maintain proper adhesion between the buttons and the tape. Additionally, the fabric may be damaged or stained by the adhesive and the back sides of the buttons must always be flat. Further, when a button is transferred to the button clamp of a sewing machine, the button cannot be correctly positioned on the button clamp thus rendering the arrangement less than practical. It is possible to improve the arrangement by designing buttons adapted for automatic stitching, but from the viewpoint of apparel design such a restriction is not desirable.

SUMMARY OF THE INVENTION

With the foregoing in mind, it is an object of the invention to provide a new and improved tape for feeding buttons and other accessories to a sewing machine.

According to the invention, buttons or other accessories are temporarily fixed in a line on a lower sheet keeping all of the button holes aligned in a predetermined direction. The buttons are covered with another thin upper sheet thereby sandwiching the buttons between the upper and lower sheets. Thereafter, the button feed tape is fed into a special button stitching machine, and after the buttons are stitched, the button feed tape is moved up and separated from the buttons.

Thus, the invention greatly contributes to the automation of stitching work and the elimination of manual labor.

BRIEF DESCRIPTION OF THE DRAWINGS

The accompanying drawings, referred to herein and constituting a part hereof, illustrate preferred embodiments of the invention and, together with the description, serve to explain the principles of the invention, wherein.

DETAILED DESCRIPTION OF THE DRAWINGS

Figure 1:
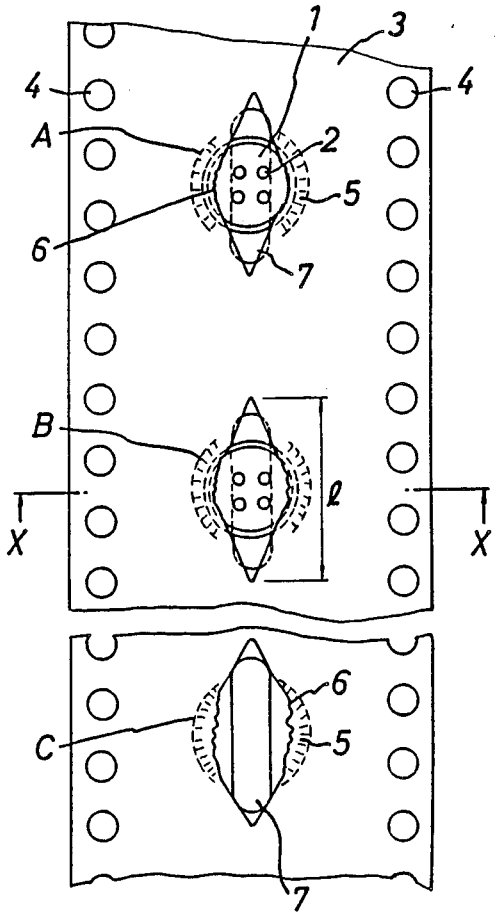
FIG. 1 is a plan view of a button feed tape according to the invention.

Referring to the accompanied drawings, a preferred embodiment of the present invention will be explained hereinafter. Referring to FIG. 1, numeral 1 denotes a button with four button holes and the directional position of the button holes is set so as to be aligned in one predetermined direction and the button temporarily fixed and sandwiched in the button feed tape 3.

Figure 2:
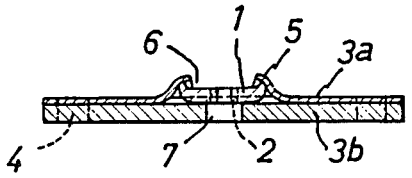
FIG. 2 is a sectional view along line X—X of FIG. 1.

Referring to FIG. 2, the button feed tape 3 comprises a upper sheet 3*a* and a lower sheet 3*b*. The thicknesses of sheets 3*a*, 3*b* in the drawings are not realistic but rather are exaggerated for ease of explanation. The lower sheet 3*b* is preferably a non-easily deformed gum tape and is spooled into a reel. Sprocket holes 4 are provided to transport the button feed tape 3. In order to easily peel the button feed tape 3 off of the button 1 after stitching, an oblong hole 7 is provided in the lower sheet 3*b*. Buttons are placed at the center of this oblong hole 7, at predetermined spaces, in a single line. The button holes are all kept aligned in one direction, and the thin, flexible upper sheet 3*a* overlays the lower sheet 3*b*.

When the width of the upper sheet 3*a* and the lower sheet 3*b* are the same, the sprocket hole 4 pierces through both the upper and lower sheets. Slits (openings) 6 are provided to expose the buttonholes, and the slit length is L (refer to FIG. 1). When the upper sheet 3*a* and the lower sheet 3*b* are attached together with buttons 1 in between, since the button is projecting outward, the upper sheet 3*a* is strained and a circular area 5 is deformed causing the upper sheet 3*a* to split. Thereby, the slit 6 is provided and the buttonhole 2 is exposed.

Referring to FIG. 1, "B" shows the button feed tape when the button has been placed in the button tape, and "C" shows the button feed tape when the button has been separated after stitching (the button tape having been peeled off).

Figure 3:
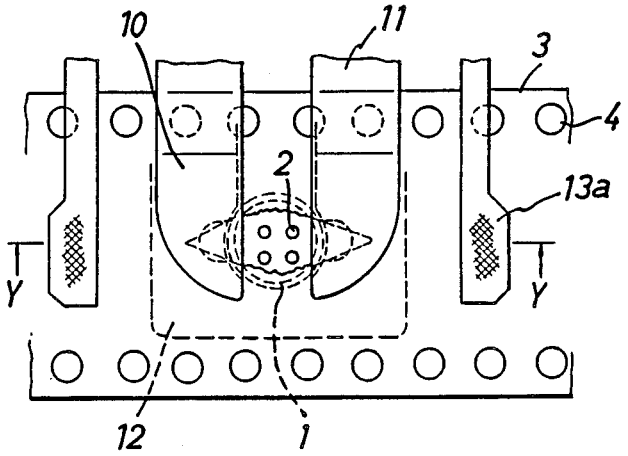
FIG. 3 is a plan view of the button feed tape of FIG. 1 on a sewing machine.

Referring to FIG. 3, the button feed tape 3 is transferred by sprocket holes 4 to the button stitching machine (driving mechanism not shown). The button 1 is transferred to the needle hole position where the button is clamped by the clamp 11 which provides plate spring 10 at its end. Then, the clamp 11 comes down and presses the button 1 and the button feed tape 3. The clamp 11 narrows its legs, thereby holding the button with the plate spring 10 and the clamp 11. Under such circumstances, as shown in FIG. 4, sheet pressers 13*a*, 13*b* sandwich the button feed tape 3 and thus fix the button feed tape 3.

According to this type of button stitching machine, the clamp 11 is oscillated with an amplitude equal to the pitch of the button holes while the button feed tape 3 is fixed by the sheet pressers 13*a*, 13*b*. As a result, the button is in almost a floating condition and the button is exposed outside (uncovered from the upper sheet 3*a*). When the button stitching is finished, clamp 11 opens outward to release the button 1 and then clamp 11 moves up.

Thereafter, the sheet pressers 13*a*, 13*b* move up with the button feed tape 3 sandwiched in between. Then, the button passes through the oblong hole 7, and the button is separated from the button feed tape 3, since the button 1 is stitched and fixed to the workpiece.

Figure 4:
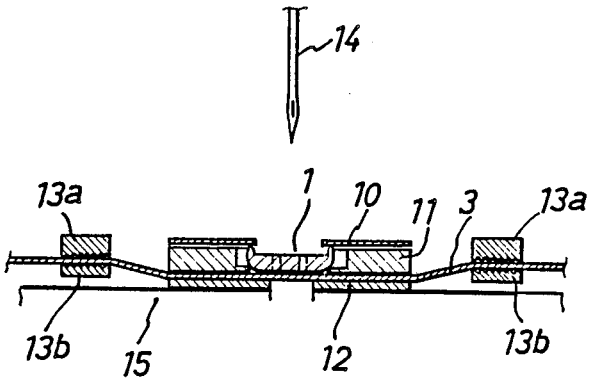
FIG. 4 is a sectional view along line Y—Y of FIG. 3.

Referring to FIG. 4, numeral 12 denotes a throat plate which oscillates with the clamp 11. As aforementioned, buttons 1 which are placed in one row and in good order are sandwiched between the sheets 3*a*, 3*b*, and thereby buttons are fed to the correct position continuously without causing problems. Thus, the button feeding speed is increased and productivity is enhanced.

In the aforementioned embodiment, the width of the upper sheet 3*a* and the lower sheet 3*b* are the same, but it is possible to shorten the width of the upper sheet 3*a* to less than that of the lower sheet 3*b*. Also, sprocket holes 4 are provided on both sides of the button feed tape but it is possible to provide sprocket holes only on one side. It is also possible to set several kinds of buttons, if the buttons are arranged systematically, even though the sizes and shapes are different. Thus, it is possible to stitch different kinds of buttons to the workpiece continuously.

It is to be understood that the above-described embodiments of the invention are illustrative only and that modifications thereof may be made without departing from the scope and spirit of the invention. For example, while the embodiments described above all involve the stitching of buttons, the invention is equally applicable to the stitching of hooks, snaps, etc., and also for combining various different styles and sizes of buttons, hooks, and snaps.

I claim:

1. A button feed tape for feeding buttons to a sewing machine, comprising:

(a) an upper sheet providing a plurality of evenly spaced longitudinal slits therein, (b) a lower sheet providing a plurality of evenly spaced longitudinal oblong holes therein; and (c) a plurality of buttons, each of said buttons having at least one button hole therein; wherein said upper and lower sheets are attached together with the evenly spaced longitudinal slits of said upper sheets and said evenly spaced longitudinal oblong holes aligned together and enclosing the buttons between said upper and lower sheets thereby keeping the button holes aligned in one direction.

2. A button feed tape for feeding buttons to a sewing machine according to claim 1, wherein said upper and lower sheets provide a multiplicity of evenly spaced longitudinal holes along at least one side for feeding the button tape.

3. A button feed tape for feeding buttons to a sewing machine according to claim 1, wherein said lower sheet comprises a non-easily deformed gum tape.

* * * * *